US006282750B1

(12) United States Patent
Bishop et al.

(10) Patent No.: US 6,282,750 B1
(45) Date of Patent: Sep. 4, 2001

(54) POWER ADJUSTMENT SIZE INDICATOR FOR A DOOR CLOSER

(75) Inventors: Arthur Bishop, Walsall (GB); Mark Braunlich, Princeton; Thomas H. Blanford, Wyanet, both of IL (US); Michael Wasielewski, Augusta, GA (US)

(73) Assignee: Ingersoll-Rand Architectural Hardware Group Limited, Birmingham (GB)

( * ) Notice: Subject to any disclaimer, the term of this patent is extended or adjusted under 35 U.S.C. 154(b) by 0 days.

(21) Appl. No.: 09/419,420

(22) Filed: Oct. 15, 1999

(51) Int. Cl.[7] ..... E05F 1/08; E05F 1/00

(52) U.S. Cl. ..... 16/79; 16/277; 16/71; 16/72

(58) Field of Search ..... 16/72, 79, 277, 16/69, 71, DIG. 10, DIG. 39, 298–301, 62, 64, 78; 116/204, 282, 283, 321; 267/175, 177

(56) References Cited

U.S. PATENT DOCUMENTS 4,590,639 5/1986 Fritsche et al. ..... 16/79
4,686,739 * 8/1987 Fritsche et al. ..... 16/79
4,783,882 * 11/1988 Frolov ..... 16/72
5,265,306 * 11/1993 Yu ..... 16/51

FOREIGN PATENT DOCUMENTS

2574554-A1 * 6/1986 (FR) .
2158148-A * 11/1985 (GB) .
2180294-A * 3/1987 (GB) .
2 180 294 A 3/1987 (GB) ..... 16/72

* cited by examiner

*Primary Examiner*—James R. Brittain
*Assistant Examiner*—Ruth C. Rodriguez
(74) *Attorney, Agent, or Firm*—Michael Best & Friedrich LLP

(57) ABSTRACT

A gear driven dial indicator is used to indicate the door closer size for a door closer having an adjustable closing force. A drive gear is attached to the door closer adjustment screw. In the preferred embodiment, this drive gear engages a ring gear which is formed as part of the dial indicator. As the door closer adjustment screw is turned to change the door closer size, the drive gear turns with the adjustment screw. The drive gear then turns the planetary gear which turns the dial indicator, thereby changing the indicated size of the door closer.

13 Claims, 3 Drawing Sheets

POWER ADJUSTMENT SIZE INDICATOR FOR A DOOR CLOSER

BACKGROUND OF THE INVENTION

This invention relates generally to door closers and more particularly to door closers having a means for adjusting the closing force of the door closer.

Door closers are sized using ANSI 1154 standards or other international standards. The ANSI standards specify, among other requirements, the minimum closing force required for the door to be specified as a size 1, 2, 3, 4, 5, or 6. The higher the size, the greater the closing force of the door closer and thus the door.

Current door closers typically provide a means to increase and decrease this closing force. One prior art adjustable door closer is shown in FIG. 1. This is accomplished by changing the pre-load on the closer spring. The adjustment means is typically a screw at the end of the closer; rotating the screw in one direction increases the pre-load; rotating in the other direction decreases the pre-load. Typically, the installation instruction sheet informs the installer of the number of rotations and the direction to turn the adjustment screw for specific size doors.

A problem arises in that as the screw is turned, and the door closer is adjusted, there is no indicator showing the ANSI size.

The foregoing illustrates limitations known to exist in present door closers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a size indicator for use with a door closer having a rotary adjustable closing force means, the size indicator comprising: a rotatable dial indicator positioned about the rotary adjustable closing force means, the rotatable dial indicator having a plurality of indicia thereon; and a gear assembly operably connecting the rotary adjustable closing force means to the rotatable dial indicator.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
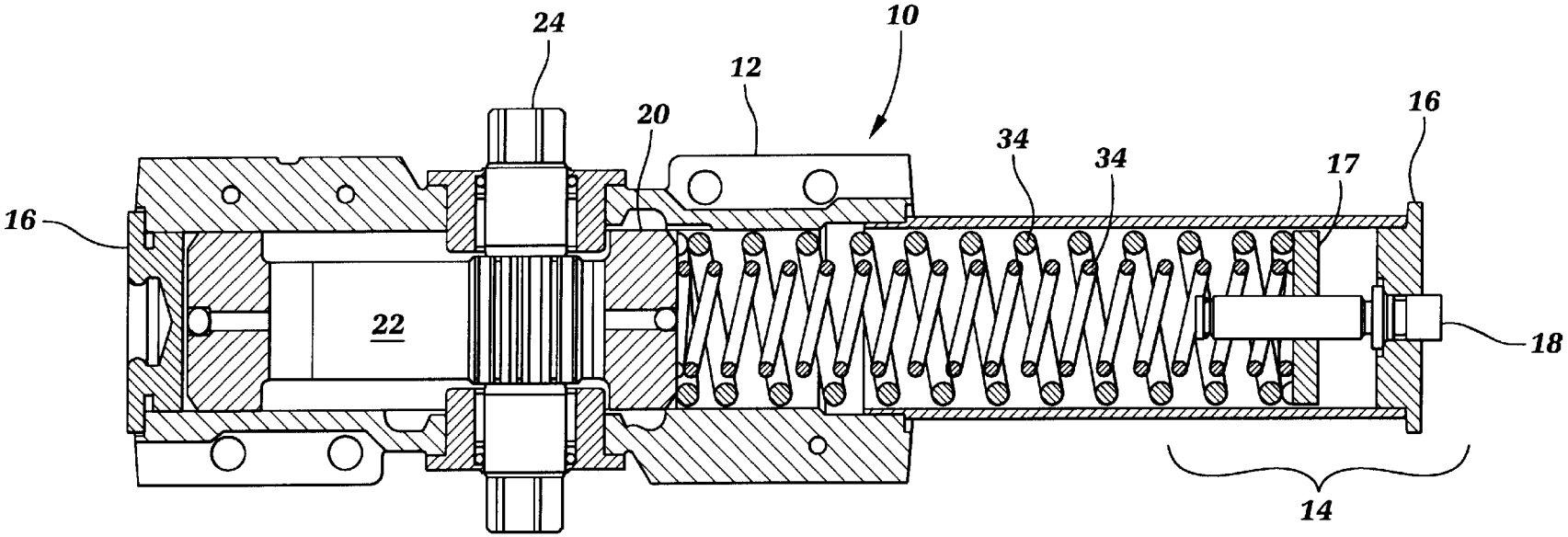
Fig. 1 (Prior Art)
FIG. 1 shows a prior art door closer.

FIG. 1 shows a typical prior art door closer 10 with one type of size adjustment mechanism 14. The illustrated door closer 10 uses a plurality of adjustable power springs 34. The door closer 10 includes a cylinder housing 12 with removable end caps 16 sealing the ends of the housing 12. The closer 10 also includes a piston 20 slidably positioned within the cylinder housing 12. The piston 20 includes a rack 22 which engages with the gear teeth on a rotatable pinion 24. A door control arm (not shown) is connected to the pinion 24 so that opening of a door would cause clockwise rotation of the pinion 24. The pinion 24 in turn acts through the rack 22 to slide the piston 20 to the right within the cylinder 12, as shown in FIG. 1. A force applied to the piston 20, such as by springs 34, urging the piston 20 to the left in FIG. 1 would operate through the rack 22 and pinion 24 to close the door.

The adjustment mechanism 14 includes a disk 17 adjacent one end cap 16. This adjustment mechanism 14 includes a rotatable screw member 18 which engages the disk 17. As the screw member 18 is rotated in a first direction, the disk 17 is moved towards the piston 20, thereby increasing the pre-load force of the closing springs 34 on the piston 20. Rotating the screw member 18 in the other direction moves the disk 17 away from the piston 20, thereby decreasing the pre-load force of the closing springs 34 on the piston 20.

Figure 2:
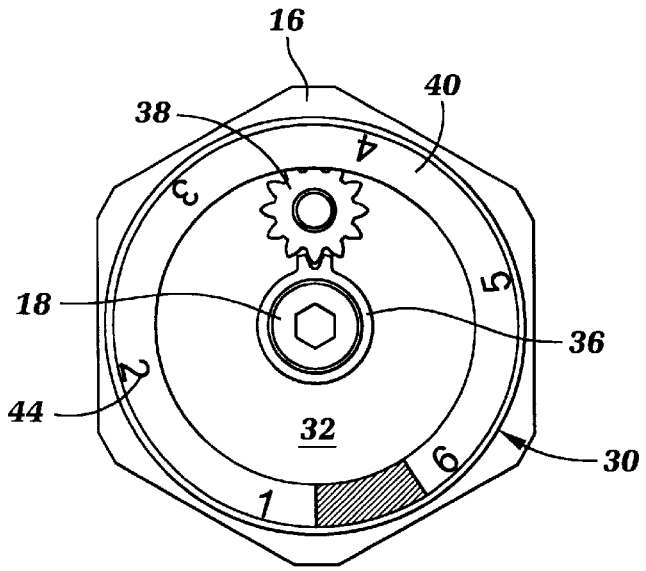
FIG. 2 is a plan view of a door closer power adjustment size indicator with a cover removed.
Figure 3:
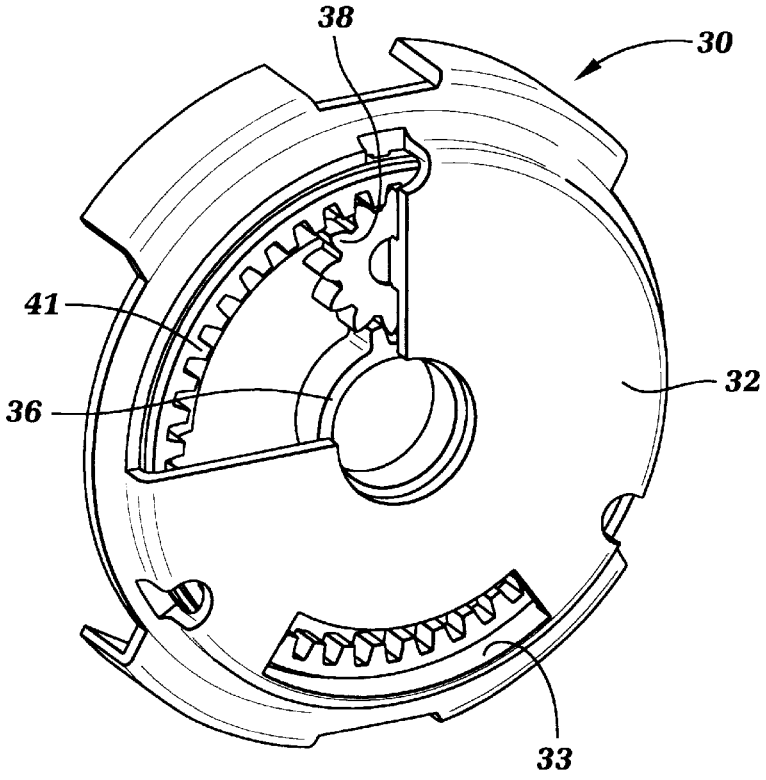
FIG. 3 is a perspective view of the power adjustment size indicator shown in FIG. 2 with a portion of the cover removed.

FIGS. 2 and 3 show the preferred embodiment of the power size adjustment indicator 30 of the present invention. The power size adjustment indicator 30 is mounted on an end 16 of door closer 10 positioned about the rotatable adjustment screw 18. The power size adjustment indicator 30 includes a front cover 32. Mounted within the front cover 32 is a double-toothed gear 36 which grippingly engages adjustment screw 18, a planetary gear 38 which is rotatably operated by the double-toothed gear 36, and a dial indicator 40 which has ring gear 41 on its underside, as shown in FIG. 3, the ring gear 41 being rotatably driven by the planetary gear 38. The front side of the dial indicator 40 includes a plurality of numerals 44 representing the ANSI door closer sizes 1 through 6. Preferably, the front cover 32 has a cutout 33 or clear portion through which the appropriate door size numeral can be seen. Alternatively, the power size adjustment indicator 30 can be mounted such that the appropriate door closer size numeral 44 is the one which is upright when viewed from a person standing on the floor adjacent the door. Other gear configurations can be used in place of the double-toothed gear 36, such as a three-toothed gear, a single-toothed gear or a gear having teeth about its entire periphery.

In use, when a person desires to change the door closer size setting of a door closer, the adjustment screw 18 is turned in the appropriate direction. Rotation of the adjustment screw 18 will increase or decrease the closing pre-load applied by springs 34. When adjustment screw 18 is turned, double-toothed gear 36 turns also. Once a revolution, the teeth on the double-toothed gear 36 will engage planetary gear 38 causing planetary gear 38 to rotate. As planetary gear 38 rotates, dial indicator 40 rotates due to the engagement of planetary gear 38 with ring gear 41. After multiple rotations of the adjustment screw 18, the dial indicator 40 will have moved from one door closer size to the next.

Figure 4:
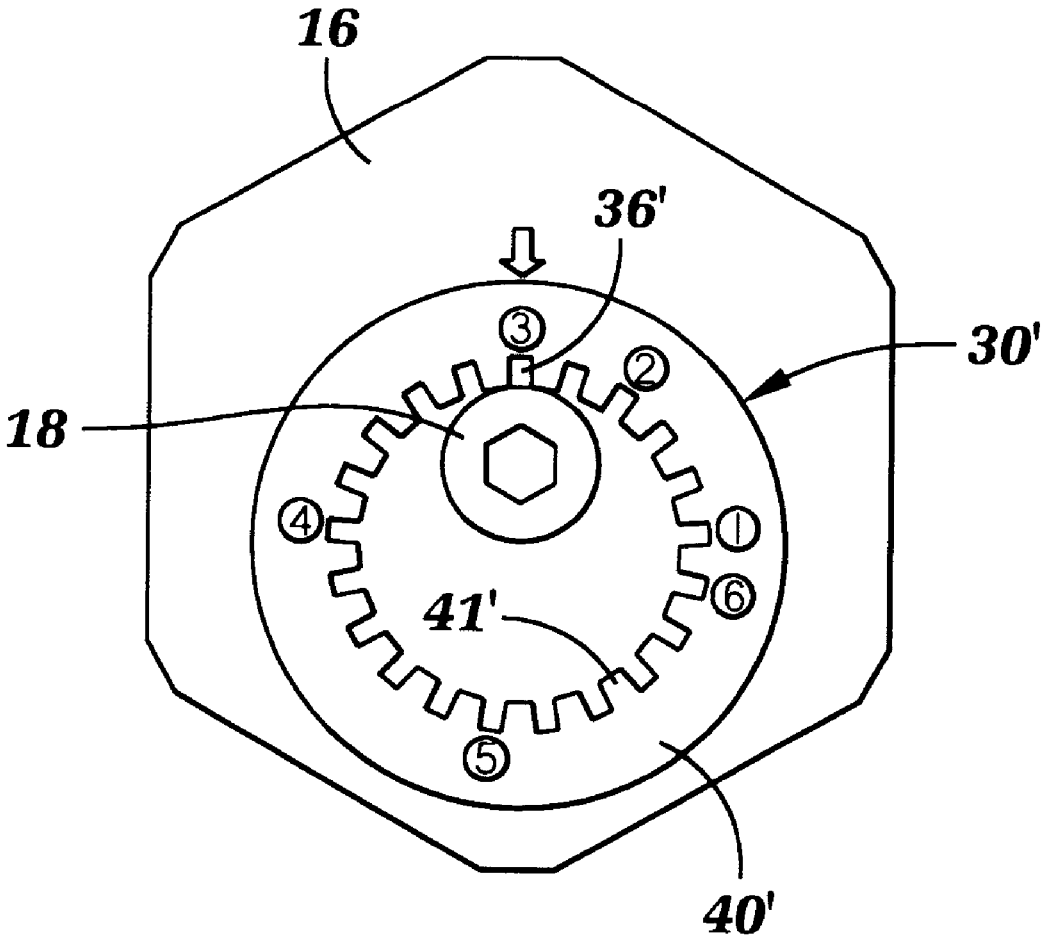
FIG. 4 is a plan view of a second embodiment of a door closer power adjustment size indicator.

FIG. 4 shows an alternate embodiment of the power size adjustment indicator 30'. In this alternate embodiment, the planetary gear is eliminated and a single-toothed gear 36' directly engages the dial indicator 40' and ring gear 41'. In this alternate embodiment, the dial indicator 40' axis is offset from the axis of the adjustment screw 18. In the preferred embodiment, the axis of the dial indicator 40 is coincident with the axis of the adjustment screw 18.

What is claimed is:

1. A size indicator for use with a door closer having a rotary adjustable closing force means, the size indicator comprising:

a rotatable dial indicator substantially surrounding the rotary adjustable closing force means, the rotatable dial indicator having a plurality of indicia thereon; and a gear assembly operably connecting the rotary adjustable closing force means to the rotatable dial indicator.

2. The size indicator according to claim 1, wherein the gear assembly includes the rotatable dial indicator comprising a ring gear having gear teeth on an inner circumference of the ring gear.

3. The size indicator according to claim 2, wherein the gear assembly further includes a drive gear attached to the rotary adjustable closing force means.

4. The size indicator according to claim 3, wherein the drive gear is a double-toothed gear.

5. The size indicator according to claim 3, wherein the gear assembly further includes a planetary gear driven by the drive gear, the planetary gear driving the ring gear.

6. The size indicator according to claim 2, wherein the rotatable dial indicator rotates about an indicator axis, which is offset from a closing means axis around which the rotary adjustable closing force means rotates.

7. The size indicator according to claim 2, wherein the rotatable dial indicator rotates about an indicator axis, which is coaxial with a closing means axis around which the rotary adjustable closing force means rotates.

8. A size for use with a door closer having a rotary adjustable closing force means, the size indicator comprising:

a rotatable dial indicator positioned about the rotary adjustable closing force means, the rotatable dial indicator having a plurality of indicia thereon and comprising a ring gear having gear teeth on an inner circumference; and a gear assembly operably connecting the rotary adjustable closing force means to the rotatable dial indicator, the gear assembly including a drive gear attached to the rotary adjustable closing force means.

9. The size indicator according to claim 8, wherein the gear assembly further includes a planetary gear driven by the drive gear, the planetary gear driving the ring gear.

10. In combination:

a door closer, the door closer having a rotatable closing pre-load adjustment means; and a pre-load adjustment indicator comprising: a rotatable dial indicator attached to an end of the door closer and positioned about the rotatable closing pre-load adjustment means, the rotatable dial indicator having a plurality of indicia thereon and comprising a ring gear having gear teeth on an inner circumference of the ring gear; and a drive gear attached to the rotatable closing pre-load adjustment means, the drive gear being operably connected to the rotatable dial indicator ring gear.

11. The combination according to claim 10, further comprising a planetary gear driven by the drive gear, the planetary gear driving the ring gear.

12. The combination according to claim 10, wherein the rotatable dial indicator rotates about an indicator axis, which is offset from a closing means axis around which the rotary adjustable closing force means rotates.

13. The combination according to claim 10, wherein the rotatable dial indicator rotates about an indicator axis, which is coaxial with a closing means axis around which the rotary adjustable closing force means rotates.

* * * * *